US009415445B2

(12) United States Patent
Sun

(10) Patent No.: US 9,415,445 B2
(45) **Date of Patent: *Aug. 16, 2016**

(54) METHOD FOR PRODUCING NEODYMIUM-IRON-BORON RARE EARTH PERMANENT MAGNETIC MATERIAL

(71) Applicant: China North Magnetic & Electronic Technology Co., LTD, Shenyang, Liaoning (CN)

(72) Inventor: Haotian Sun, Liaoning (CN)

(73) Assignee: China North Magnetic & Electronic Technology Co., LTD, Shenyang, Liaoning (CN)

( * ) Notice: Subject to any disclaimer, the term of this patent is extended or adjusted under 35 U.S.C. 154(b) by 459 days.

This patent is subject to a terminal disclaimer.

(21) Appl. No.: 14/040,710

(22) Filed: Sep. 29, 2013

(65) Prior Publication Data

US 2015/0243433 A1 Aug. 27, 2015

(30) Foreign Application Priority Data

May 5, 2013 (CN) ..... 2013 1 0160440

(51) Int. Cl.

| | |
|---|---|
| ***H01F 1/053*** | (2006.01) |
| ***B22F 9/04*** | (2006.01) |
| ***C22C 33/02*** | (2006.01) |
| ***H01F 1/057*** | (2006.01) |
| ***H01F 41/02*** | (2006.01) |
| *B22F 3/24* | (2006.01) |

(52) U.S. Cl.

CPC ..... *B22F 9/04* (2013.01); *C22C 33/0278* (2013.01); *H01F 1/0577* (2013.01); *H01F 41/0273* (2013.01); *B22F 3/24* (2013.01); *B22F 2003/248* (2013.01); *B22F 2009/044* (2013.01); *B22F 2998/10* (2013.01)

(58) Field of Classification Search

CPC ..... H01F 1/0577

See application file for complete search history.

(56) References Cited

U.S. PATENT DOCUMENTS

| | | | | |
|---|---|---|---|---|
| 5,383,978 | A | 1/1995 | Yamamoto et al. | |
| 6,461,565 | B2 | 10/2002 | Tokuhara et al. | |
| 6,491,765 | B2 | 12/2002 | Okayama et al. | |
| 6,527,874 | B2 | 3/2003 | Li | |
| 6,537,385 | B2 | 3/2003 | Okayama et al. | |
| 2005/0028892 | A1* | 2/2005 | Sasaki | B22F 1/0007 148/302 |
| 2013/0049908 | A1* | 2/2013 | Yuan | H01F 41/0266 335/302 |
| 2014/0328711 | A1* | 11/2014 | Sun | B22F 1/0081 419/20 |

FOREIGN PATENT DOCUMENTS

| | | | | |
|---|---|---|---|---|
| CN | 1182548 | | 12/2004 | |
| CN | 1195600 | | 4/2005 | |
| CN | 1272809 | | 8/2006 | |
| CN | 101055779 | A * | 10/2007 | |
| CN | 101315825 | A * | 12/2008 | |
| CN | WO 2011134179 | A1 * | 11/2011 | C22C 38/002 |
| JP | 06108104 | A * | 4/1994 | |

OTHER PUBLICATIONS

Machine translation of CN101315825A. Dec. 2008.*
Machine translation of JP06108104A, Apr. 1994.*
Machine translation of CN101055779A, Oct. 2007.*

* cited by examiner

*Primary Examiner* — Jie Yang
*Assistant Examiner* — Xiaowei Su

(57) ABSTRACT

A method for producing neodymium-iron-boron rare earth permanent magnetic materials comprises: controlling technological parameters of alloy smelting, coarsely pulverization, milling by jet mill, and compaction; and adding nano-sized micro powder of oxide, in such a manner that a particle size of milling by the jet mill is decreased, and fine powder collected by the powder filter and powder collected by a cyclone collector are mixed. Utilization rate of the materials and performance of magnets are significantly improved. Usage amount of rare earth is significantly saved, especially usage amount of heavy rare earth. Thus, the scarce resources are protected.

8 Claims, No Drawings

METHOD FOR PRODUCING NEODYMIUM-IRON-BORON RARE EARTH PERMANENT MAGNETIC MATERIAL

BACKGROUND OF THE PRESENT INVENTION

1. Field of Invention

The present invention relates to a field of permanent magnetic materials, and more particularly to a method for producing neodymium-iron-boron rare earth permanent magnetic materials.

2. Description of Related Arts

Neodymium-iron-boron rare earth permanent magnetic materials are widely applied in the nuclear magnetic resonance imaging of medical industry, hard disk drivers of computers, loudspeaker boxes, mobiles, etc., because of its excellent magnetic property. To meet the requirements of energy-saving and the low carbon economy, the neodymium-iron-boron rare earth permanent magnetic materials are applied in fields of automobile parts, household appliances, energy-saving and controlling motors, hybrid electric vehicles, wind power generation, etc.

In 1982, Japan Sumitomo Special Metals Co. firstly disclosed the neodymium-iron-boron rare earth permanent magnetic materials in Japanese patents 1,622,492 and 2,137,496, and then applied for United States patents and European patents. The characteristic, ingredients, and producing method of the neodymium-iron-boron rare earth permanent magnetic materials were disclosed. The main phase is Nd2Fe14B phase, and the grain boundary phases are Nd-rich phase, B-rich phase, and impurities comprising rare earth oxides.

On Apr. 1, 2007, Japan Hitachi Metals Co. was merged with Japan Sumitomo Special Metals Co., and took up the rights and obligations of the patent licenses of the neodymium-iron-boron rare earth permanent magnetic materials of Japan Sumitomo Special Metals Co. on Aug. 17, 2012, Japan Hitachi Metals Co. submitted a case to United States International Trade Commission (ITC), based on the fact that Japan Hitachi Metals Co. owns the patents U.S. Pat. Nos. 6,461,565, 6,491,765, 6,537,385, and 6,527,874 applied in United States.

The patent U.S. Pat. No. 6,461,565 has an application date of May 8, 2001, and the application number in China is CN1195600C. It is recorded in the patent that magnetic compaction is not easy to be realized in a protective atmosphere, so magnetic compaction in an atmospheric condition was applied to be protected, wherein the working temperature range is 5° C.~30° C., the relative humidity is between 40% and 65%, and the powder compacting is processed under the conditions described above.

Based on the patent U.S. Pat. No. 6,491,765 applied on May 9, 2001, and the patent U.S. Pat. No. 6,537,385 applied on Jul. 9, 2001, a patent CN1272809C is applied in China. A milling process finished by an inert gas jet mill having an oxygen content of 0.02~5% is protected by the patents, wherein a part of ultrafine powder having a grain diameter less than 1 μm is removed by a cyclone collector, in such a manner that the proportion of the ultrafine powder having the grain diameter less than 1 μm is controlled under 10%. It is a natural process that a part of ultrafine powder having the grain diameter less than 1 μm is removed, because the cyclone collector is used to collect the powder combined with the jet mill.

Strip casting technology related to smelting process of neodymium-iron-boron rare earth permanent magnetic alloys comprising at least one of the metal elements Nb and Mo is required to be protected in the patent U.S. Pat. No. 6,527,874 applied on Jul. 10, 2001 by Japan Hitachi Metals Co., and the Chinese patent CN1182548C. The strip casting technology was used in smelting process sintering magnets by Japan SanDe Metal Co. in 1992. The Japanese patent JP4,028,656 was granted in United States in January of 1995, and the patent number is U.S. Pat. No. 5,383,978. Then it was granted in Europe, and the patent numbers are EP0556751B1 and EP0632471B1.

The conventional method for producing neodymium-iron-boron rare earth permanent magnetic materials comprises: alloy smelting, hydrogen pulverization, milling by the jet mill, magnetic compaction, vacuum sintering, mechanical processing and aging process.

SUMMARY OF THE PRESENT INVENTION

With expanding of application market of neodymium-iron-boron rare earth permanent magnetic materials, a problem of shortage of rare earth resources becomes more and more serious. Especially in fields of electronic components, energy-saving and controlling motors, automobile parts, new energy automobiles, wind power, etc., more heavy rare earth is required to increase coercivity. Therefore, how to reduce a usage amount of the rare earth, especially the usage amount of the heavy rare earth, is an important topic in front of us. After exploration, we develop a neodymium-iron-boron rare earth permanent magnetic material of high performance, and a method for producing the neodymium-iron-boron rare earth permanent magnetic material.

The present invention is realized by a following technical solution.

The neodymium-iron-boron rare earth permanent magnetic material refers to alloy magnets R—Fe—B-M or R—Fe—Co—B-M, and R refers to one or a plurality of rare earth elements.

M refers to one or a plurality of elements selected from the group consisting of Al, Nb, Ga, Zr, Cu, V, Ti, Cr, Ni, Hf, Ta, W, Mo, S, C, N, and O.

A producing method in the present invention is as follows.

1. Alloy smelting process

Smelting method of the alloys comprises an ingot casting process, which comprises heating raw materials of the neodymium-iron-boron rare earth permanent magnetic materials to be an alloy in a molten state under a condition of vacuum or protective atmosphere; and then pouring the alloy in the molten state into a water-cooled mould under a condition of vacuum or protective atmosphere to form an alloy ingot. Preferably, an ingot casting process comprises moving or rotating a mould while pouring, in such a manner that an ingot thickness is 1~20 mm. Preferably, an alloy smelting method comprises a strip casting process, which comprises heating and melting an alloy, and pouring the molten alloy on a rotating roller with a water cooling device via a tundish, wherein the molten alloy becomes an alloy slice after cooled by the rotating roller, a cooling speed of the rotating roller is 100~1000° C./S, and a temperature of the cooled alloy slice is 550~400° C. Preferably, a method comprises cooling the alloy slice again by collecting the alloy slice with a rotating cylinder after the alloy slice leaves a rotating copper roller. Preferably, a method comprises cooling the alloy slice again by collecting the alloy slice with a turntable after the alloy slice leaves a rotating copper roller, wherein the turntable is below the copper roller, and an inert gas cooling device with a heat exchanger and a mechanical stirring device are provided above the turntable. Preferably, a method comprises preserving heat of the alloy slice by a secondary cooling device after the alloy slice leaves the rotating copper roller and before the alloy slice is cooled again, wherein a period of heat preserving is 10~120 min, and a temperature of heat preserving is 550~400° C.

2. Coarsely Pulverization Process

Coarsely milling method of the alloy mainly comprises two methods, i.e., mechanical pulverization and hydrogen pulverization. The mechanical pulverization comprises milling the alloy ingot smelted into particles having a grain diameter less than 5 mm with a milling device, such as jaw crusher, hammer crusher, ball mill, rod mill, and disc mill, under a protection of nitrogen. At present, the mechanical pulverization is scarcely used, and the hydrogen pulverization is widely used.

The hydrogen pulverization comprises: feeding the alloy slice or the alloy ingot obtained by the previous process into a vacuum hydrogen pulverization furnace, which is evacuated and filled with hydrogen, in such a manner that the alloy in the vacuum hydrogen pulverization furnace absorbs the hydrogen, wherein a temperature of hydrogen adsorption is usually less than 200° C., and a pressure of hydrogen adsorption is usually 50~200 KPa; after absorbing the hydrogen, evacuating the vacuum hydrogen pulverization furnace again and heating to dehydrogenate the alloy, wherein a temperature of dehydrogenation is usually 600~900° C.; and cooling the particles after dehydrogenation, under the condition of vacuum or protective atmosphere, wherein the protective atmosphere is embodied as an argon protective atmosphere.

Preferably, the hydrogen pulverization comprises: feeding the alloy ingot or the alloy slice into the rotating cylinder, which is evacuated and then filled with hydrogen, in such a manner that the alloy absorbs the hydrogen; stopping filling the rotating cylinder with hydrogen until the alloy is saturated with hydrogen; keeping the state for more than 10 minutes; evacuating the rotating cylinder, then heating the alloy while rotating the rotating cylinder to dehydrogenate the alloy under the condition of vacuum, wherein the temperature of dehydrogenation is usually 600~900° C.; and cooling the rotating cylinder after dehydrogenation.

Preferably, the hydrogen pulverization relates to a continuous producing method of rare earth permanent magnetic alloy and its device. The device comprises a hydrogen adsorption chamber, a heating dehydrogenation chamber, a cooling chamber, chamber-isolating valves, a charging basket, a transmission device, a evacuating device; wherein the hydrogen adsorption chamber, the heating dehydrogenation chamber and the cooling chamber are respectively connected via the chamber-isolating valves, the transmission device is provided in upper portions of the hydrogen adsorption chamber, the heating dehydrogenation chamber and the cooling chamber, the charging basket is hanged on the transmission device, materials in the charging basket is transported to the hydrogen adsorption chamber, the heating dehydrogenation chamber and the cooling chamber in turn along the transmission device. When the device is working, the alloy is fed in the charging basket hanged on the transmission device, and the charging basket carrying the alloy is transported to the hydrogen adsorption chamber, the heating dehydrogenation chamber and the cooling chamber in turn by a suspended drive, in such a manner that the alloy is processed with hydrogen adsorption, heating and dehydrogenation, and cooling in turn. Then the alloy is stored in a storage drum under the condition of vacuum or protective atmosphere.

3. Milling Process

A method for producing alloy powder comprises milling by a jet mill. The jet mill comprises: a feeder; a milling chamber, wherein a nozzle is provided in a lower portion thereof, and a sorting wheel is provided in an upper portion thereof; a weighing system for controlling a powder weight and a feeding speed in the milling chamber; a cyclone collector; a powder filter; and a gas compressor. The working gas is embodied as nitrogen, and a pressure of compressed gas is 0.6~0.8 MPa. When the jet mill is working, the powder obtained by the previous process is fed into the feeder of the jet mill firstly. The powder is added into the milling chamber under controlling of the weighing system. The powder is grinded by high-speed airflow sprayed by the nozzle. The powder grinded rises with the airflow. The powder meeting a milling requirement enters into the cyclone collector to be collected via the sorting wheel, and the coarse powder not meeting the milling requirement goes back to the lower portion of the milling chamber under an effect of centrifugal force to be grinded again. The powder entering into the cyclone collector is collected in a material collector in an lower portion of the cyclone collector as a finished product. Because the cyclone collector cannot collect all of the powder, a few fine powder is discharged with the airflow. This part of fine powder is filtered by a powder filter, and collected in a fine powder collector provided in a lower portion of the powder filter. Generally, a weight ratio between the fine powder and the whole powder is less than 15%, and a grain diameter is less than 1 μm. This part of powder has a rare earth concentration higher than an average rare earth concentration of the whole powder, so this part of powder is easy to be oxygenated. Once this part of powder enters into the cyclone collector, performance of a magnet will decrease. To solve this problem, the patent CN1272809C proposed that the ratio of the fine powder having the grain diameter less than 1 μm should be controlled strictly, and the fine powder filtered by the powder filter is thrown away as waste powder. As an average grain diameter of neodymium-iron-boron power becomes smaller and smaller, the ratio of this part of powder becomes larger and larger.

To increase the performance of the magnet and utilization rate of materials, the present invention improved the jet mill milling technology, and solved the problem of milling the neodymium-iron-boron powder into particles having the average grain diameter less than 1 μm. Preferably, a method comprises: evenly mixing the powder hydrogen-pulverized with one or more selected from the group consisting of nano-sized micro powder of lanthanum oxide, cerium oxide, praseodymium oxide, neodymium oxide, dysprosium oxide, terbium oxide, yttrium oxide, titanium oxide, ferric oxide, aluminum oxide, zirconia, tungsten oxide, and molybdenum oxide firstly, milling by the jet mill, controlling a particle size of the powder by a vane-type sorting wheel of the jet mill, collecting the powder by the cyclone collector, collecting the fine power discharged by gas exhaust pipes of the cyclone collector in the powder filter, and adding the fine powder collected by the powder filter and the powder collected by the cyclone collector into a two-dimensional or three-dimensional mixing machine to mix with each other under the protection of nitrogen; wherein a mixing period is more than 30 min, an oxygen content in a mixing atmosphere is less than 150 ppm, an oxygen content in atmosphere of the jet mill is less than 50 ppm, a weight ratio between nano-sized micro powder of oxide and the power hydrogen-pulverized twice is less than 3%, and an average particle size of the oxide powder is less than 80 nm.

4. Compaction Process

Compaction of neodymium-iron-boron rare earth permanent magnets is most different from compaction of common powder metallurgy in compaction under an oriented magnetic field, so an electromagnet is provided on a press. Because neodymium-iron-boron rare earth permanent magnetic powder tends to be oxygenated, some patents proposed that an environmental temperature while compaction is controlled between 5° C. and 35° C., a relative humidity is 40%~65%, and an oxygen content is 0.02~5%. To prevent the powder from being oxygenated, preferably, a compacting device comprises a protecting box and gloves provided on the protecting box, wherein the powder is processed withwith magnetic compaction under a protective atmosphere. Preferably, a cooling system is provided in a magnetic space in the protecting box, and a temperature of a magnetic compaction space can be controlled. Moulds are displaced in a microthermal space which has a controllable temperature. The powder is compacted into compacts in a controlled temperature, and the temperature is controlled between −15° C. and 20° C. Preferably, the compacting temperature is less than 5° C. An oxygen content in the protecting box is less than 200 ppm, preferably, 150 ppm. An oriented magnetic field intensity in a chamber of the mould is generally 1.5~3T. The magnetic field is oriented in advance before magnetic powder is compacted into the compacts, and the oriented magnetic field intensity remains unchanged while compaction. The oriented magnetic field is embodied as a constant magnetic field, or a pulsating magnetic field, i.e., an alternating magnetic field. To decrease a compacting pressure, isostatic pressing is processed after the magnetic compaction, and then the material is transported into a sintering furnace to be sintered after the isostatic pressing.

5. Sintering Process

The sintering process is after the compaction process. In a conventional technology, the sintering process is finished in a vacuum sintering furnace, and under the condition of vacuum or protective atmosphere. A protective gas is embodied as argon. A sintering temperature is 1000~1200° C. A heat preservation period is generally 0.5~20 hours. Argon is used to cool the material after heat preservation. Preferably, a sintering device comprises a valve and a transferring box with gloves provided in front of the vacuum sintering furnace. The compacts which have be processed with the compaction are transported into the transferring box under the condition of protective atmosphere. The transferring box is filled with the protective gas. Under the condition of protective atmosphere, outer packings of the compacts are removed, and the compacts are fed into a sintering box. Then the valve between the transferring box and the sintering furnace is opened. The sintering box carrying the compacts is transported into the vacuum sintering furnace to be sintered by a transport mechanism in the transferring box. Preferably, a multi-chamber vacuum sintering furnace is used for sintering. Degasification, sintering, and cooling are respectively finished in different vacuum chambers. The transferring box with gloves is connected with the vacuum chambers via the valve. The sintering box passes through the vacuum chambers in turn. The sintering temperature is 950~1050° C.

6. Aging Process

Parts sintered are optionally processed with machining, and then the parts sintered are transported into an aging furnace to be processed with high-temperature aging and low-temperature aging. A temperature of high-temperature aging is 850~950° C., and a temperature of low-temperature aging is 450~650° C. The parts are processed with machining and surface treatment.

The method for producing the neodymium-iron-boron rare earth permanent magnetic material is improved in the present invention. The nano-sized micro powder of oxide is added before the milling process by the jet mill. While the jet mill is working, the nano-sized oxide is adhered around the powder to protect the powder from being further oxygenated. The oxygen content in the powder can be controlled. The particle size of the powder can be less than 1 μm. The powder collected by the cyclone collector and the powder collected by the powder filter are mixed by controlling the oxygen content in the jet mill. Not only magnetic performance and corrosion resistance of the magnet and are improved, but also the utilization rate of materials is increased, in such a manner that the usage amount of the rare earth is saved, especially the usage amount of the heavy rare earth. The scarce resources are protected. The method for producing the neodymium-iron-boron rare earth permanent magnetic material is new and high-performance.

These and other objectives, features, and advantages of the present invention will become apparent from the following detailed description, the accompanying drawings, and the appended claims.

DETAILED DESCRIPTION OF THE PREFERRED EMBODIMENT

The embodiments are described as follows to further illustrate remarkable effects of the present invention.

Embodiment 1

600 kg of alloy A, B, C, or D is taken to be smelted, and composition of the alloy is listed in Table 1. The alloy in a molten state is poured on a rotating cooling roller with a water cooling device to be cooled and form an alloy slice. The alloy slice leaves the rotating cooling roller made of copper, and falls on a turntable. The alloy slice is cooled again with an inert gas cooling device with a heat exchanger and a mechanical stirring device. The alloy slice cooled again is fed into a hanging charging basket, and the charging basket carrying the alloy slice is transported to a hydrogen adsorption chamber, a heating dehydrogenation chamber and a gas cooling chamber of a continuous vacuum hydrogen pulverization furnace in turn by a suspended drive, in such a manner that the alloy is processed with hydrogen adsorption, heating and dehydrogenation, and cooling in turn. The alloy slice hydrogen-pulverized and micro powder of oxide listed in Table 2 are added into a two-dimensional mixing machine to mix with each other. An average particle size of the micro powder is 60 nm, and a weight ratio of the micro powder is 0.12%. A mixing period is 40 minutes. After mixing, milling process is processed with a jet mill. An average particle size of the powder in a cyclone collector is 2.4 μm. Fine powder in a powder filter and the powder collected in the cyclone collector are added in the two-dimensional mixing machine under protection of nitrogen to mix with each other for 30 minutes. Atmosphere of the jet mill has an oxygen content of 40 ppm. Compacting process is embodied as magnetic compaction under the protection of nitrogen. An oxygen content in a protecting box is 130 ppm. A temperature in a chamber of a mould is 3° C., when the powder is compacted into compacts. Each of the compacts has a size of 50×40×30 mm. A direction of an oriented magnetic field is embodied as a direction of a height, i.e. 30 mm. The compacts are packaged after being compacted in the oriented magnetic field. The compacts are taken out from the protecting box, and processed with isostatic pressing. The compacts are transported into a vacuum sintering furnace to be sintered, and then the compacts are processed with aging treatment twice. A sintering temperature is 1030° C. Aging temperatures are respectively 850° C. and 580° C. A sample having a size of 10×10×10 mm is taken out to take part in a weight-loss experiment for 48 hours. An average weight loss is 0.9 mg/cm$^2$. Weights of the powder collected by the cyclone collector, weights of the fine powder collected by a fine powder collector, kinds of the micro powder of oxide added, and data of magnetic performance are showed in Table 2.

Embodiment 2

600 kg of alloy E, F, G, H, I, or J is taken to be smelted, and composition of the alloy is listed in Table 1. The alloy in a molten state is poured on the rotating cooling roller with the water cooling device to be cooled and form an alloy slice. The alloy slice leaves the rotating cooling roller made of copper, and falls on the turntable. The alloy slice is cooled again with the inert gas cooling device with the heat exchanger and the mechanical stirring device after heat preservation for 60 minutes. The alloy slice cooled again is hydrogen-pulverized with a rotating vacuum hydrogen pulverization furnace. The alloy slice is fed into a rotating cylinder, which is evacuated and then filled with hydrogen. The alloy slice absorbs the hydrogen. Filling the rotating cylinder with hydrogen is stopped, after the alloy slice is saturated with hydrogen. Then the rotating cylinder is evacuated, and the alloy slice is heated. Meanwhile, the rotating cylinder is rotated to dehydrogenate the alloy slice under a condition of vacuum. The cylinder is cooled with argon after dehydrogenation. The alloy slice hydrogen-pulverized and the micro powder of oxide listed in Table 2 are added into the two-dimensional mixing machine to mix with each other. The average particle size of the micro powder is 40 nm, and a weight ratio of the micro powder is 0.12%. When there are two kinds of oxide, the two kinds of oxide have equal weights. The mixing period is 40 minutes. After mixing, milling process is processed with the jet mill. An average particle size of the powder in the cyclone collector is 1.8 μm. Fine powder in the powder filter and the powder collected in the cyclone collector are added in the two-dimensional mixing machine to mix with each other for 50 minutes. The atmosphere of the jet mill has an oxygen content of 10 ppm. A gas temperature in a milling chamber is 20° C. The compacting process is embodied as the magnetic compaction under the protection of nitrogen. The oxygen content in the protecting box is 90 ppm. The temperature in a chamber of a mould is 0° C., when the powder is compacted into compacts. Each of the compacts has a size of 50×40×30 mm. A direction of an oriented magnetic field is embodied as a direction of a height, i.e. 30 mm. The compacts are packaged after being compacted in the oriented magnetic field. The compacts are taken out from the protecting box, and processed with isostatic pressing. The compacts are transported into the vacuum sintering furnace to be sintered, and then the compacts are processed with aging treatment twice. The sintering temperature is 1040° C. The aging temperatures are respectively 950° C. and 530° C. A sample having a size of 10×10×10 mm is taken out to take part in a weight-loss experiment for 48 hours. An average weight loss is 0.6 mg/cm$^2$. Weights of the powder collected by the cyclone collector, weights of the fine powder collected by a fine powder collector, kinds of the micro powder of oxide added, and data of magnetic performance are showed in Table 2.

Embodiment 3

600 kg of alloy K, L, or M is taken to be smelted, and composition of the alloy is listed in Table 1. The alloy in a molten state is poured on the rotating cooling roller with the water cooling device to be cooled and form an alloy slice. The alloy slice leaves the rotating cooling roller made of copper, and falls on the turntable. The alloy slice is cooled again with the inert gas cooling device with the heat exchanger and the mechanical stirring device after heat preservation for 60 minutes. The alloy slice cooled again is hydrogen-pulverized with the rotating vacuum hydrogen pulverization furnace. The alloy slice is fed into the rotating cylinder, which is evacuated and then filled with hydrogen. The alloy slice absorbs the hydrogen. Filling the rotating cylinder with hydrogen is stopped, after the alloy slice is saturated with hydrogen. Then the rotating cylinder is evacuated, and the alloy slice is heated. Meanwhile, the rotating cylinder is rotated to dehydrogenate the alloy slice under a condition of vacuum. The cylinder is cooled after dehydrogenation. The alloy slice hydrogen-pulverized and the micro powder of oxide listed in Table 2 are added into the two-dimensional mixing machine to mix with each other. The average particle size of the micro powder is 10 nm, and a weight ratio of the micro powder is 0.12%. When there are a plurality of kinds of oxide, the kinds of oxide have equal weights. The mixing period is 30 minutes. After mixing, milling process is processed with the jet mill. An average particle size of the powder in the cyclone collector is 1.3 μm. The jet mill is embodied as a nitrogen jet mill. The powder is collected by the cyclone collector. Fine powder discharged by gas exhaust pipes of the cyclone collector is collected in a fine powder collector connected with the cyclone collector. Ultrafine powder discharged by gas exhaust pipes of the fine powder collector is collected by the powder filter. The fine powder collected by the fine powder collector and the powder collected by the cyclone collector are added in the two-dimensional mixing machine under the protection of nitrogen to mix with each other for 10 minutes. The atmosphere of the jet mill has an oxygen content of 10 ppm. The gas temperature in the milling chamber is 45° C. The compacting process is embodied as the magnetic compaction under the protection of nitrogen. The oxygen content in the protecting box is 90 ppm. The temperature in a chamber of a mould is −5° C., when the powder is compacted into compacts. Each of the compacts has a size of 50×40×30 mm. The direction of an oriented magnetic field is embodied as a direction of a height, i.e. 30 mm. The compacts are packaged after being compacted in the oriented magnetic field. The compacts are taken out from the protecting box, and processed with isostatic pressing. The compacts are transported into the vacuum sintering furnace to be sintered, and then the compacts are processed with aging treatment twice. The sintering temperature is 1040° C. The aging temperatures are respectively 900° C. and 430° C. A sample having a size of 10×10×10 mm is taken out to take part in a weight-loss experiment for 48 hours. An average weight loss is 0.4 mg/cm$^2$. Weights of the powder collected by the cyclone collector, weights of the fine powder collected by a fine powder collector, kinds of the micro powder of oxide added, and data of magnetic performance are showed in Table 2.

TABLE 1

| Composition of alloy | | |
|---|---|---|
| Num. | Code | Composition |
| 1 | A | Nd30Dy1Fe67.9B0.9A10.2 |
| 2 | B | Nd30Dy1Fe67.5Co1.2Cu0.1B0.9A10.1 |
| 3 | C | Nd25Dy5Fe66.3Co2.4Cu0.2B0.9A10.2 |
| 4 | D | Nd24Dy5Fe65.9Co3.6Cu0.3B0.9A10.3 |
| 5 | E | (Pr0.2Nd0.8)25Dy5Fe67.4Co1.2Cu0.3B0.9A10.2 |
| 6 | F | (Pr0.2Nd0.8)25Dy5Tb1Fe65Co2.4Cu0.3B0.9A10.2Ga0.1Zr0.1 |
| 7 | G | (Pr0.2Nd0.8)22Dy5Gd2Ho2Fe63.8Co3.6Cu0.2B0.9A10.4Ga0.1 |
| 8 | H | (Pr0.2Nd0.8)23Dy5Ho2Fe64.7Co3.6Cu0.2B0.9A10.4Ga0.1Nb0.1 |
| 9 | I | (Pr0.25Nd0.75)25Dy5Fe65.9Co2.4Cu0.3B0.9A10.4Ga0.1 |
| 10 | J | (Pr0.25Nd0.75)21Dy10Fe62.2Co4.8Cu0.3B1.1A10.4Ga0.1Zr0.1 |
| 11 | K | (Pr0.2Nd0.8)27Dy2Gd2Fe63.7Co3.6Cu0.3B1.1A10.2Ga0.1 |
| 12 | L | (Pr0.2Nd0.8)27Dy2Ho2Fe62.4Co4.8Cu0.3B1.0A10.2Ga0.2Zr0.1 |
| 13 | M | (Pr0.2Nd0.8)21Dy10Fe60.9Co6Cu0.3B1A10.2Ga0.3Zr0.2Nb0.1 |

TABLE 2

| Magnetic performance measuring results of magnets in the present invention | | | | | | | |
|---|---|---|---|---|---|---|---|
| Num. | Code | Power weight (Kg) | Fine powder weight (Kg) | Type of oxide micro powder | Magnetic energy product (MGOe) | Residual magnet-ism (Gs) | Coer-civity (Oe) |
| 14 | A | 535 | 35 | $Pr_20_3$ | 48.6 | 14112 | 18453 |
| 15 | B | 545 | 30 | $Nd_20_3$ | 47.2 | 14180 | 18540 |
| 16 | C | 545 | 35 | $Al_20_3$ | 39.7 | 12680 | 29170 |
| 17 | D | 545 | 30 | $Zr0_2$ | 38.6 | 12530 | 29160 |
| 18 | E | 535 | 40 | $Pr_20_3$ + $Nd_20_3$ | 38.6 | 12540 | 29320 |
| 19 | F | 535 | 40 | $Al_20_3$ + $Nd_20_3$ | 38.4 | 12680 | 29860 |
| 20 | G | 530 | 45 | $Zr0_2$ + $Nd_20_3$ | 35.8 | 12090 | 29450 |
| 21 | H | 530 | 45 | $Al_20_3$ + $Zr0_2$ | 36.7 | 12180 | 29960 |
| 22 | I | 535 | 43 | $Pr_20_3$ + $Al_20_3$ | 37.8 | 12400 | 29230 |
| 23 | J | 535 | 45 | $Pr_20_3$ + $Zr0_2$ | 32.4 | 11550 | 32650 |
| 24 | K | 512 | 68 | $Al_20_3$ + $Nd_20_3$ + $Pr_20_3$ | 38.7 | 12540 | 25540 |
| 25 | L | 516 | 63 | $Zr0_2$ + $Nd_20_3$ + $Al_20_3$ | 38.7 | 12375 | 25810 |
| 26 | M | 514 | 65 | $Zr0_2$ + $Al_20_3$ + $Nd_20_3$ + $Pr_20_3$ | 33.6 | 11490 | 32920 |

TABLE 3

| Magnetic performance measuring results of magnets in various comparison examples | | | | | | | |
|---|---|---|---|---|---|---|---|
| Num. | Code | Power weight (Kg) | Fine powder weight (Kg) | Type of oxide micro powder | Magnetic energy product (MGOe) | Residual magnet-ism (Gs) | Coer-civity (Oe) |
| 27 | A | 530 | 0 | — | 47.1 | 13965 | 14563 |
| 28 | B | 535 | 0 | — | 46.4 | 14000 | 14400 |
| 29 | C | 540 | 0 | — | 37.2 | 12390 | 25320 |
| 30 | D | 535 | 0 | — | 37.3 | 12560 | 26500 |
| 31 | E | 540 | 0 | — | 37.1 | 12390 | 25320 |
| 32 | F | 540 | 0 | — | 37.3 | 12560 | 26500 |
| 33 | G | 540 | 0 | — | 34.4 | 11830 | 26300 |
| 34 | H | 530 | 0 | — | 34.3 | 12070 | 26080 |
| 35 | I | 540 | 0 | — | 35.5 | 12290 | 26030 |
| 36 | J | 535 | 0 | — | 31.6 | 11440 | 29300 |

TABLE 3-continued

| Magnetic performance measuring results of magnets in various comparison examples | | | | | | | |
|---|---|---|---|---|---|---|---|
| Num. | Code | Power weight (Kg) | Fine powder weight (Kg) | Type of oxide micro powder | Magnetic energy product (MGOe) | Residual magnet-ism (Gs) | Coer-civity (Oe) |
| 37 | K | 530 | 0 | — | 37.9 | 12386 | 21306 |
| 38 | L | 530 | 0 | — | 36.1 | 12260 | 21789 |
| 39 | M | 530 | 0 | — | 32.5 | 11380 | 29000 |

COMPARISON EXAMPLE 1

600 kg of the alloy A, B, C, or D is taken to be smelted, and composition of the alloy is listed in Table 1. The comparison example 1 is same as embodiment 1, except not adding the fine power collected by the powder filter and the micro powder of oxide. A sample having a size of 10×10×10 mm is taken out to take part in the weight-loss experiment for 48 hours. An average weight loss is 4.6 mg/cm$^2$. Measuring results of magnetic performance is shown in Table 3.

COMPARISON EXAMPLE 2

600 kg of the alloy E, F, G, H, I, or J is taken to be smelted, and composition of the alloy is listed in Table 1. The alloy in the molten state is processed with casting to form an ingot having a thickness of 12 mm. The comparison example 2 is same as embodiment 2, except not adding the fine power collected by the powder filter and the micro powder of oxide, and not controlling the particle size of milling by the jet mill to be 3.2 μm. A sample having a size of 10×10×10 mm is taken out to take part in the weight-loss experiment for 48 hours. An average weight loss is 3.3 mg/cm$^2$. Measuring results of magnetic performance is shown in Table 3.

COMPARISON EXAMPLE 3

600 kg of the alloy K, L, or M is taken to be smelted, and composition of the alloy is listed in Table 1. The alloy in the molten state is processed with casting to form an ingot having a thickness of 12 mm. The comparison example 2 is same as embodiment 3, except not adding the fine power collected by the powder filter and the micro powder of oxide, and not controlling the particle size of milling by the jet mill to be 3.2 μm. A sample having a size of 10×10×10 mm is taken out to take part in the weight-loss experiment for 48 hours. An average weight loss is 2.6 mg/cm$^2$. Measuring results of magnetic performance is shown in Table 3.

The above embodiments show that the oxygen content of the jet mill is controlled, and the nano-sized micro powder of oxide is added, in such a manner that the fine power in the powder filter of the jet mill is added to the powder collected by the cyclone collector. Technical parameters of procedures are controlled, in such a manner that the performance of the magnets is improved. The present invention significantly improves the utilization rate of the materials, and significantly saves usage amount of rare earth, especially usage amount of heavy rare earth. Magnetic energy product, coercivity, corrosion resistance of rare earth permanent magnets are significantly improved, while saving the rare earth. Thus, the scarce resources are protected.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for producing neodymium-iron-boron rare earth permanent magnetic material, comprising steps of: alloy smelting; pulverization; milling; magnetic compaction; vacuum sintering; and aging; wherein a particle size obtained by the step of pulverization is larger than that of the step of milling, and the step of milling comprises: firstly, evenly mixing the powder obtained by pulverization with one or more nano-sized powder selected from the group consisting of praseodymium oxide, neodymium oxide, aluminum oxide and zirconia, to obtain a mixture; and secondly, milling the mixture by a jet mill;

wherein in the step of milling the mixture by the jet mill, the jet mill is a jet air flow mill; a particle size of the powder is controlled by a size sorting wheel; the powder is collected by a cyclone collector; powder with a grain diameter less than 1 μm discharged by gas exhaust pipes of the cyclone collector is collected by a filter; then the powder with the grain diameter less than 1 μm collected by the filter and the powder collected by the cyclone collector are mixed under a protection of nitrogen; and an oxygen content of the atmosphere in the jet mill is less than 50 ppm.

2. The method for producing the neodymium-iron-boron rare earth permanent magnetic material, as recited in claim 1, wherein an average particle size of the one or more nano-sized powder selected from the group consisting of praseodymium oxide, neodymium oxide, aluminum oxide and zirconia is 10~60 nm.

3. The method for producing the neodymium-iron-boron rare earth permanent magnetic material, as recited in claim 1, wherein the step of alloy smelting is a vacuum induction melting; the alloy in a molten state is poured onto a cooling roller cooled with a water-cooling device to form an alloy slice; the alloy slice leaves the cooling roller and falls in a rotating cylinder or a turntable to be processed with heat temperature holding; and the alloy slice is cooled again after the temperature holding.

4. The method for producing the neodymium-iron-boron rare earth permanent magnetic material, as recited in claim 1, wherein the step of pulverization refers to hydrogen-pulverizing the alloy with a rotating vacuum hydrogen pulverization furnace; wherein the alloy is fed into a rotating cylinder, which is evacuated and then filled with hydrogen; the alloy absorbs the hydrogen; after the alloy is saturated with hydrogen, filling the rotating cylinder with the hydrogen is stopped; then the rotating cylinder is evacuated, heated, and rotated simultaneously to dehydrogenate the alloy; dehydrogenation is processed under a condition of vacuum; and the cylinder is cooled after the dehydrogenation.

5. The method for producing the neodymium-iron-boron rare earth permanent magnetic material, as recited in claim 1, wherein the step of pulverization comprises: feeding the alloy slice into a hanging charging basket; transporting the charging basket carrying the alloy slice into a hydrogen adsorption chamber, a heating dehydrogenation chamber and a gas cooling chamber of a continuous vacuum hydrogen pulverization furnace in turn by a suspended drive, in such a manner that the alloy is processed with hydrogen adsorption, heating and dehydrogenation, and cooling in turn; and storing the alloy in a storage drum under a condition of vacuum or protective gas atmosphere.

6. A method for producing neodymium-iron-boron rare earth permanent magnetic material, comprising steps of: alloy smelting; pulverization; milling; compaction; vacuum sintering; and aging; wherein a particle size obtained by the step of pulverization is larger than that of the step of milling, and the step of milling comprises: firstly, evenly mixing the powder obtained by pulverization with one or more nano-sized powder selected from a group consisting of praseodymium oxide, neodymium oxide, aluminum oxide and zirconia, to obtain a mixture; and secondly, milling the mixture by a jet mill;

wherein the step of compaction is a magnetic compaction under a protection of nitrogen in a protecting box; an oxygen content in the protecting box is less than 150 ppm; the powder is compacted into compacts under a controlled temperature lower than 5° C.; the compacts are packaged after being compacted in a magnetic field; and the compacts are taken out from the protecting box to be processed with isostatic pressing.

7. The method for producing the neodymium-iron-boron rare earth permanent magnetic material, as recited in claim 6, wherein the step of vacuum sintering comprises: transporting compacts into a transferring box with gloves of a vacuum sintering furnace, wherein the compacts have been processed with isostatic pressing, and the compacts have a packaging in such a manner that the compacts are sealed away from atmosphere; removing the packaging of the compacts under a protective gas atmosphere; feeding the compacts into a sintering box; opening a valve of the vacuum sintering furnace; and transporting the sintering box carrying the compacts into a sintering chamber of the vacuum sintering furnace by a transmission skip car in the transferring box, in order to sinter the compacts under vacuum, wherein a sintering temperature is 950-1050° C.

8. The method for producing the neodymium-iron-boron rare earth permanent magnetic material, as recited in claim 6, wherein the step of aging comprises processing parts sintered optionally by machining; and then transporting the parts sintered into an aging furnace to process the parts by high-temperature aging followed by low-temperature aging, wherein a temperature of the high-temperature aging is 850-950° C., and a temperature of the low-temperature aging is 450-650° C.

* * * * *